US009945390B2

(12) United States Patent
Cocks et al.

(10) Patent No.: US 9,945,390 B2
(45) Date of Patent: Apr. 17, 2018

(54) CENTRIFUGAL BLOWER AND METHOD OF ASSEMBLING THE SAME

(71) Applicant: Regal Beloit America, Inc., Beloit, WI (US)

(72) Inventors: Rachele Barbara Cocks, Columbia City, IN (US); Joshua James Westhoff, Fort Wayne, IN (US); Matthew James Kleist, Rothschild, WI (US); Zachary Joseph Stauffer, Fort Wayne, IN (US); Kerry Baker Shelton, Fort Wayne, IN (US); Kamron Mark Wright, Fort Wayne, IN (US); Brian L. Beifus, Fort Wayne, IN (US)

(73) Assignee: Regal Beloit America, Inc., Beloit, WI (US)

( * ) Notice: Subject to any disclaimer, the term of this patent is extended or adjusted under 35 U.S.C. 154(b) by 514 days.

(21) Appl. No.: 14/448,507

(22) Filed: Jul. 31, 2014

(65) Prior Publication Data

US 2016/0032944 A1 Feb. 4, 2016

(51) Int. Cl.

| | |
|---|---|
| ***F04D 29/62*** | (2006.01) |
| ***F04D 29/44*** | (2006.01) |
| ***F04D 29/66*** | (2006.01) |
| ***F04D 29/68*** | (2006.01) |

(52) U.S. Cl.

CPC ..... *F04D 29/444* (2013.01); *F04D 29/626* (2013.01); *F04D 29/667* (2013.01); *F04D 29/681* (2013.01); *F05D 2250/51* (2013.01)

(58) Field of Classification Search

CPC .... F04D 29/281; F04D 29/282; F04D 29/283; F04D 29/30; F04D 29/403; F04D 29/4226; F04D 29/62; F04D 29/42; F04D 29/44; F04D 29/624; F04D 29/444; F04D 29/60; F04D 29/4213; F04D 29/681; F04D 29/667; F04D 29/626; F04D 29/40; F04D 29/4206; F04D 29/4426; F04D 29/601; F04D 29/441; F04D 17/08; F04D 17/00; F04D 17/06; F04D 17/10; F04D 17/16; F04D 13/10; F04D 2250/51; F04D 25/02; F04D 25/06; F04D 25/08

USPC ..... 415/203; 417/423.15

See application file for complete search history.

(56) References Cited

U.S. PATENT DOCUMENTS 1,873,343 A * 8/1932 Seyfried ..... F04D 29/646 248/604
2,776,088 A * 1/1957 Wentling ..... F04D 25/0613 310/67 R
2,881,995 A * 4/1959 Neher ..... F04D 29/646 181/208

(Continued)

*Primary Examiner* — Peter J Bertheaud
(74) *Attorney, Agent, or Firm* — Armstrong Teasdale LLP

(57) ABSTRACT

In one aspect, a centrifugal blower assembly is provided. The centrifugal blower assembly includes a housing defining an interior space and an impeller configured to channel an airflow within the interior space. A motor is coupled to the impeller and configured to rotate the impeller about an axis. The centrifugal blower also includes a plurality of mounting arms. Each mounting arm of the plurality of mounting arms includes a first end coupled to the housing and a second end coupled to the motor. Each mounting arm of the plurality of mounting arms has a cross-sectional profile that comprises a portion of an airfoil shape.

9 Claims, 6 Drawing Sheets

(56) References Cited

U.S. PATENT DOCUMENTS 2,936,947 A * 5/1960 Staak ..... F04D 29/626 417/353
3,775,029 A * 11/1973 Ranz ..... H02K 5/00 392/360
4,076,197 A * 2/1978 Dochterman ..... B60H 1/00464 248/604
4,200,257 A * 4/1980 Litch, III ..... F04D 29/282 248/604
4,394,111 A * 7/1983 Wiese ..... F24F 13/20 165/122
4,572,472 A * 2/1986 Eder ..... H02K 5/24 248/603
4,685,513 A * 8/1987 Longhouse ..... F01P 5/06 123/41.49
4,946,348 A 8/1990 Yapp
5,152,661 A 10/1992 Sheets
5,156,524 A 10/1992 Forni
6,092,988 A 7/2000 Botros
6,378,361 B1 * 4/2002 Larsen ..... G01M 9/04 73/147
6,443,714 B1 * 9/2002 Hollenbeck ..... F04D 25/08 417/423.1
6,478,838 B2 * 11/2002 McSweeney ..... F24F 3/16 248/603
6,638,037 B2 * 10/2003 Grant ..... F04D 29/646 248/674
6,755,157 B1 * 6/2004 Stevens ..... F04D 29/646 123/41.49
7,108,482 B2 9/2006 Chapman
7,318,850 B2 * 1/2008 Kaylan ..... B01D 46/26 55/467
7,473,071 B2 1/2009 Goerig et al.
7,500,825 B2 3/2009 Hanai
7,771,177 B2 * 8/2010 Maillard ..... B62D 25/084 417/363
8,210,806 B2 * 7/2012 Yang ..... F04D 25/12 415/204
8,231,331 B2 7/2012 Wu
8,579,582 B1 * 11/2013 Gehring ..... F04D 25/08 415/182.1
8,651,807 B2 * 2/2014 Inada ..... F04D 25/0613 415/208.2
8,672,615 B2 * 3/2014 Ruckert ..... F04D 25/0613 415/121.2
8,932,013 B2 * 1/2015 Khalitov ..... F04D 19/002 415/211.2
2005/0186070 A1 * 8/2005 Zeng ..... F04D 29/544 415/211.2
2012/0057971 A1 3/2012 Mitsuishi et al.
2014/0023536 A1 * 1/2014 Post ..... F04D 25/068 417/423.14

* cited by examiner

CENTRIFUGAL BLOWER AND METHOD OF ASSEMBLING THE SAME

BACKGROUND

The field of the disclosure relates generally to centrifugal blowers, and more specifically, to a motor mounting assembly that improves blower efficiency and reduces blower noise.

Centrifugal blowers or fans are commonly used in the automotive, air handling, and ventilation industries for directing large volumes of forced air, over a wide range of pressures, through a variety of air conditioning components. In some known centrifugal blowers, air is drawn into the blower housing through one or more inlet openings by an impeller, which defines an inlet chamber. The impeller is rotated by a motor that is mounted within the inlet chamber by a plurality of mounting arms. In some known centrifugal blowers, the mounting arms interact with the airflow entering the inlet such that the shape of the mounting arms restricts the airflow entering the inlet. Such a restriction causes drag and a turbulent airflow, which may decrease the efficiency of the blower. Furthermore, the impact of the airflow on such known non-aerodynamic mounting arms creates vibrations in the blower and generates noise, which may be objectionable to a user.

BRIEF DESCRIPTION

In one aspect, a centrifugal blower assembly is provided. The centrifugal blower assembly includes a housing defining an interior space and an impeller configured to channel an airflow within the interior space. A motor is coupled to the impeller and configured to rotate the impeller about an axis. The centrifugal blower also includes a plurality of mounting arms. At least one mounting arm of the plurality of mounting arms includes a first end coupled to the housing and a second end coupled to the motor. The at least one mounting arm also includes a cross-sectional profile that comprises a portion of an airfoil shape.

In another aspect, a mounting arm for use in a centrifugal blower assembly comprising a housing and a motor is provided. The mounting arm includes a first end coupled to the housing, a second end coupled to the motor, and a body portion extending between the first end and the second end. The body portion has a cross-sectional profile including an arcuate portion, a first substantially straight leg extending from a first end of the arcuate portion, and a second substantially straight leg extending from a second end of the arcuate portion, wherein the first leg and the second leg are tapered toward each other.

In yet another aspect, a method of assembling a centrifugal blower assembly is provided. The method includes providing a housing that defines an interior space and positioning an impeller within the housing such that the impeller is configured to channel an airflow within the interior space. A motor is coupled to the impeller such that the motor is configured to rotate the impeller about an axis. The method also includes coupling a plurality of mounting arms between the housing and the motor. Each mounting arm of the plurality of mounting arms has cross-sectional profile including an arcuate portion, a first leg extending from a first end of the arcuate portion, and a second leg extending from a second end of the arcuate portion.

Although specific features of various embodiments may be shown in some drawings and not in others, this is for convenience only. Any feature of any drawing may be referenced and/or claimed in combination with any feature of any other drawing.

DETAILED DESCRIPTION

Figure 1:
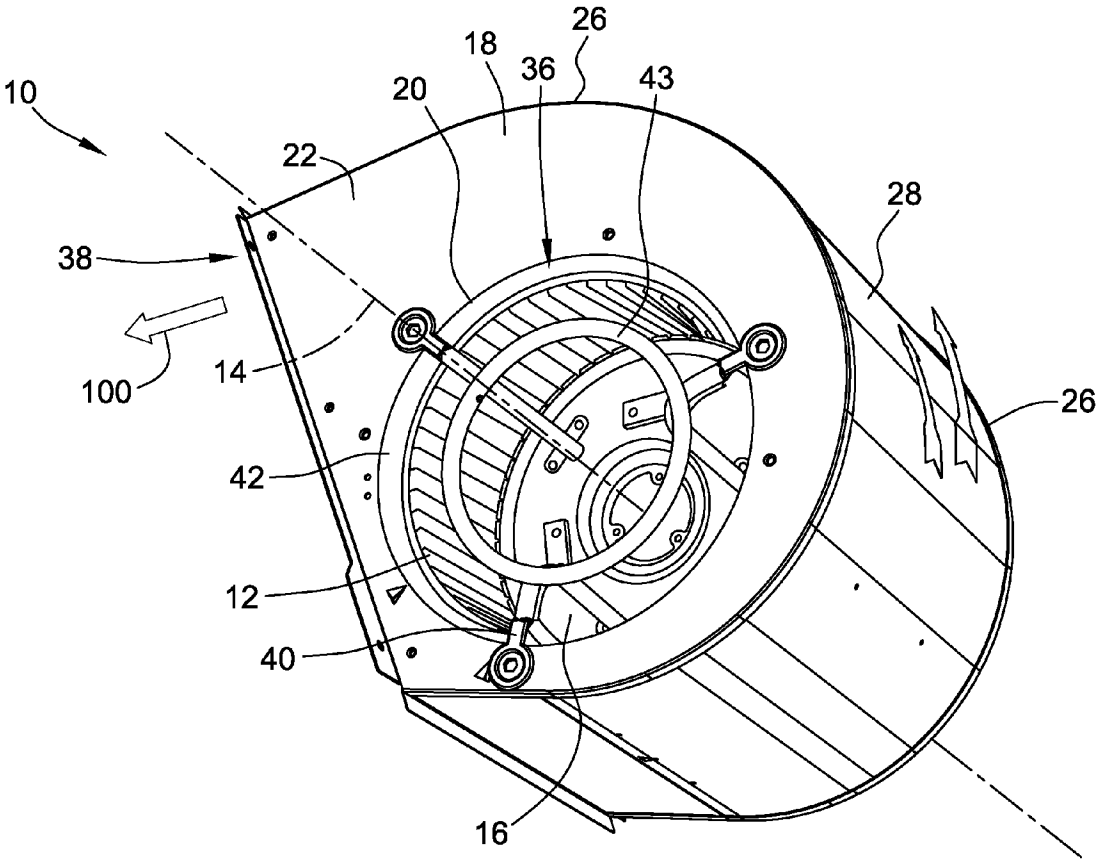
FIG. 1 is a perspective of an exemplary centrifugal blower.
Figure 2:
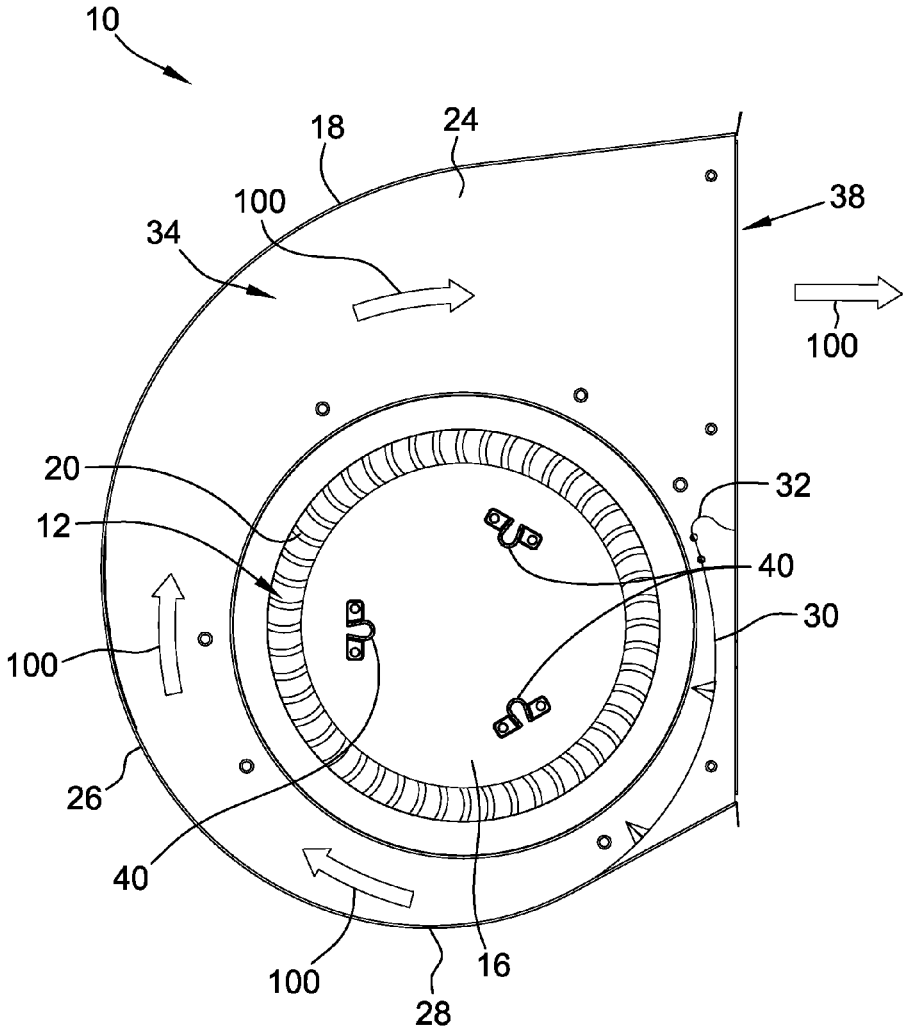
FIG. 2 is a cross-sectional view of the centrifugal blower shown in FIG. 1.

FIG. 1 is a schematic perspective view of an exemplary centrifugal blower 10. FIG. 2 is a cross-sectional view of centrifugal blower 10. In the exemplary embodiment, centrifugal blower 10 includes a fan impeller 12 having an axis of rotation 14. Fan impeller 12 is coupled to a motor 16, which is configured to rotate fan impeller 12 about axis of rotation 14. In one embodiment, motor 16 is an axial flux electric motor. In an alternative embodiment, motor 16 is a radial flux electric motor. The rotation of fan impeller 12 draws air into centrifugal blower 10 along axis of rotation 14 as represented by airflow arrows 100, and expels the air radially outward into a housing 18. In the exemplary embodiment, fan impeller 12 is formed from a plurality of forward curved fan blades 20. Alternatively, fan blades 20 may include backward curved blades, airfoil blades, backward inclined blades, radial blades, or any other suitable blade shape that enables fan impeller 12 to operate as described herein. In the exemplary embodiment, the shape of fan blades 20 of fan impeller 12 facilitates reducing operating noise of fan impeller 12. Fan impeller 12 is configured to produce a flow of air for a forced air system, e.g., without limitation, a residential HVAC system.

In the exemplary embodiment, housing 18 includes a first sidewall 22 and an opposite second sidewall 24. Sidewalls 22 and 24 are fabricated as generally flat, parallel sidewalls disposed at axially opposite ends of fan impeller 12. An outer periphery 26 of each of sidewalls 22 and 24 is shaped substantially the same and generally forms a volute shape with respect to axis of rotation 14. In the exemplary embodiment, blower 10 further includes a scroll wall 28. More specifically, scroll wall 28 is coupled to outer periphery 26 of sidewalls 22 and 24 thereby forming an increasing expansion angle for airflow 100 through housing 18. In the exemplary embodiment, scroll wall 28, which extends around fan impeller 12, includes a cutoff portion 30 including a cutoff point 32 that is at least partially disposed within an interior space 34 of housing 18. Interior space 34 is defined at least by sidewalls 22 and 24 and by scroll wall 28.

In the exemplary embodiment, housing 18 includes an air inlet opening 36 provided in first sidewall 22. Alternatively, second sidewall 24 may include an opening (not shown) to accommodate motor 16. Further, an air outlet opening 38 is defined, at least in part, by cutoff portion 30, sidewalls 22 and 24, and scroll wall 28. In the exemplary embodiment, airflow 100 is expelled from centrifugal blower 10 through air outlet opening 38. In the exemplary embodiment, each component of housing 18 may be fabricated from any material that enables housing 18 to function as described herein, for example, without limitation, aluminum, steel, thermoplastics, fiber reinforced composite materials, or any combination thereof.

Further, in the exemplary embodiment, motor 16 of centrifugal blower 10 is positioned in air inlet opening 36 and is coupled to housing 18 by a plurality of mounting arms 40. Although only three mounting arms 40 are shown, centrifugal blower 10 may include any number of mounting arms 40. In the exemplary embodiment, one of the plurality of mounting arms 40 is aligned with a direction of airflow into inlet opening 36, and the remaining mounting arms 40 are positioned in low flow rate areas about inlet opening 36 such that mounting arms 40 cause a minimal disturbance to the airflow entering inlet opening 36. In the exemplary embodiment, mounting arms 40 are evenly circumferentially-spaced about inlet opening 36. Alternatively, mounting arms 40 may be spaced in any manner that facilitates operation of blower 10 as described herein. As described in further detail below, in the exemplary embodiment, mounting arms 40 are coupled to sidewall 22 and extend into inlet opening 36 to couple to motor 16.

In an alternative embodiment, mounting arms 40 are coupled to an inlet ring 42 and extend into inlet opening 36. Inlet ring 42 is coupled to sidewall 22 and includes an arcuate surface (not shown in FIGS. 1 and 2) at inlet opening 36 to improve blower 10 efficiency.

Blower 10 further includes a turning vane 43 coupled to at least one mounting arm 40. Turning vane 43 is positioned in interior space 34 proximate inlet opening 36 and is configured to provide structural rigidity and stiffness to mounting arms 40 while also turning at least a portion of the airflow entering blower 10 through inlet opening 36. As the airflow enters inlet opening 36, it tends to follow a sloping curve over inlet ring 42 and accumulate toward a center of blades 20 between sidewalls 22 and 24. In the exemplary embodiment, turning vane 43 is configured to channel the airflow entering inlet opening 36 toward a portion of blades 20 that is proximate sidewall 22. As such, turning vane 43 is configured to distribute the airflow in a predetermined direction along blades 20 and facilitates increasing the efficiency of blower 10.

In operation, fan impeller 12 rotates about axis of rotation 14 to draw air into housing 18 through air inlet opening 36. The amount of air moved by centrifugal blower 10 increases as a point on fan impeller 12 moves within housing 18 from cutoff point 32 towards air outlet opening 38. Scroll wall 28 is positioned progressively further away from fan impeller 12 in the direction of rotation of fan impeller 12 to accommodate the increasing volume of air due to the volute shape of housing 18. Fan impeller 12 generates high velocity airflow 100 that is exhausted from air outlet opening 38. Fan impeller 12 draws airflow 100 into centrifugal blower 10 through air inlet opening 36 in the axial direction (referring to axis of rotation 14) and turns airflow 100 to a generally radial direction (generally perpendicular to axis of rotation 14).

Figure 3:
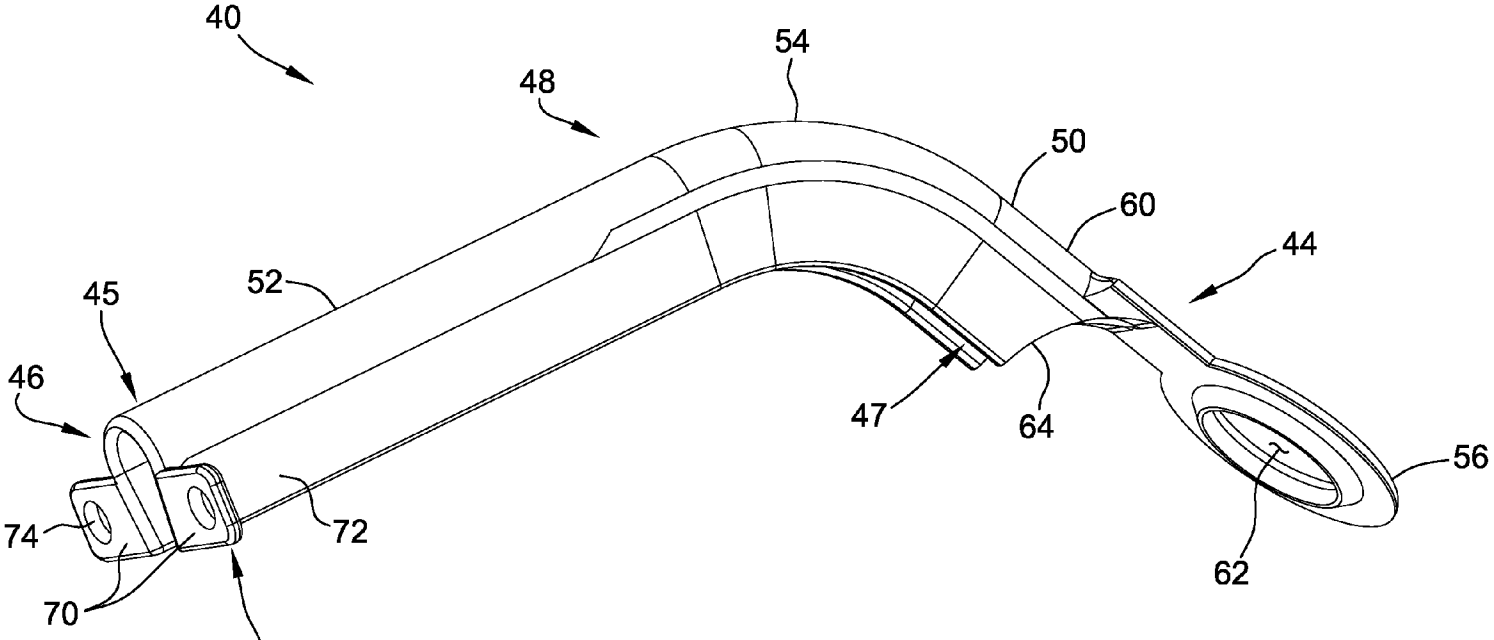
FIG. 3 is a perspective view of an exemplary mounting arm for use with the centrifugal blower shown in FIG. 1.
Figure 4:
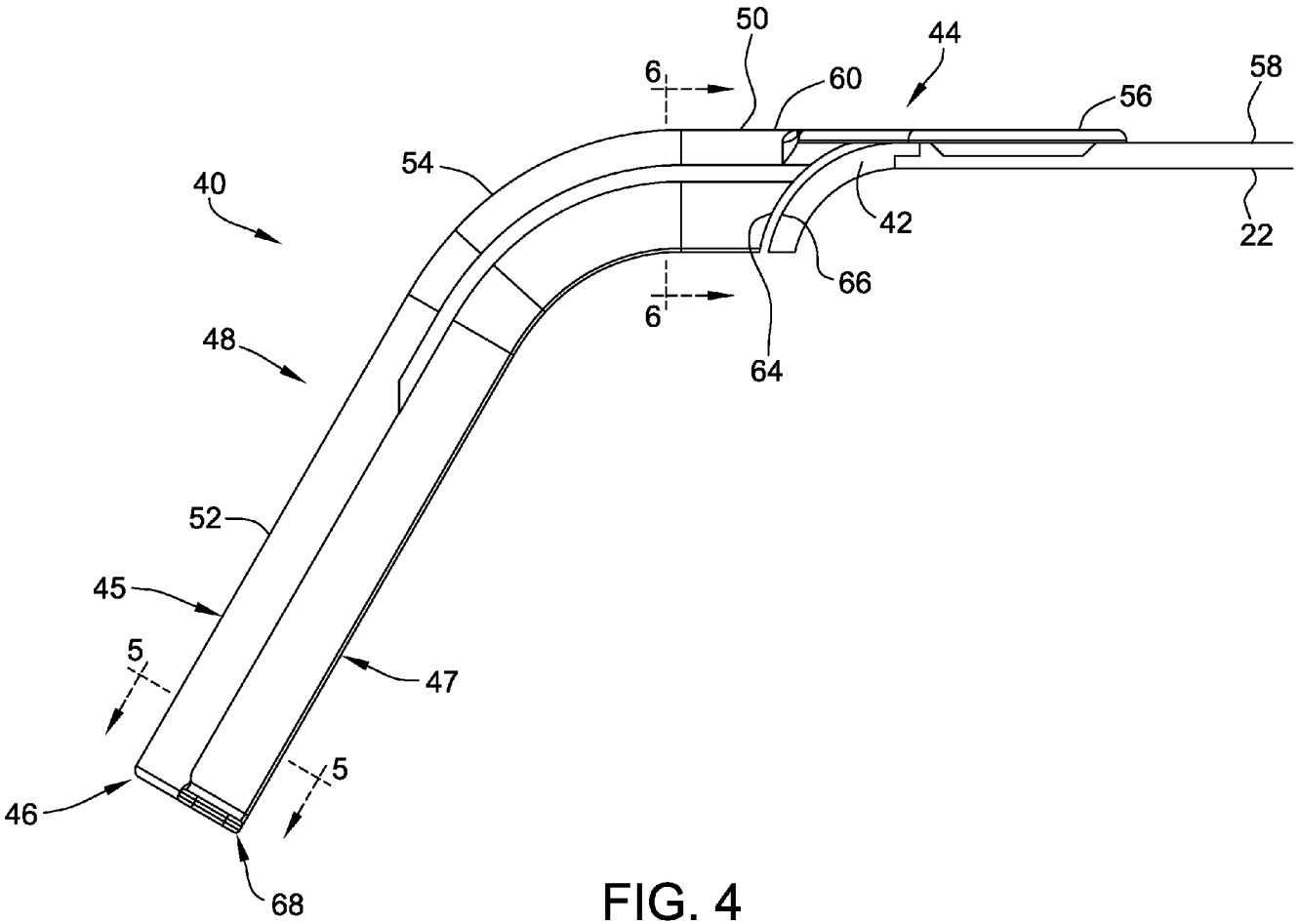
FIG. 4 is a side view of the mounting arm shown in FIG. 3.
Figure 5:
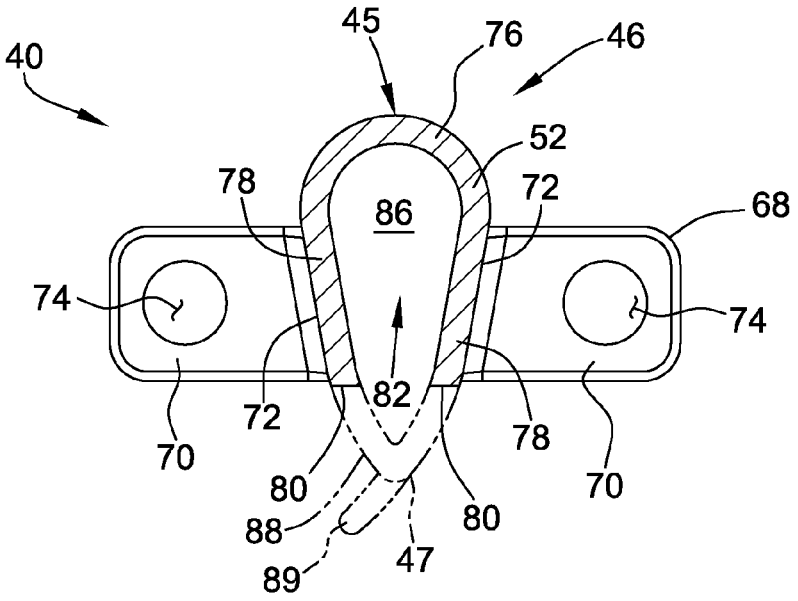
FIG. 5 is a cross-sectional view of the mounting arm shown in FIG. 4 taken along line 5-5.
Figure 6:
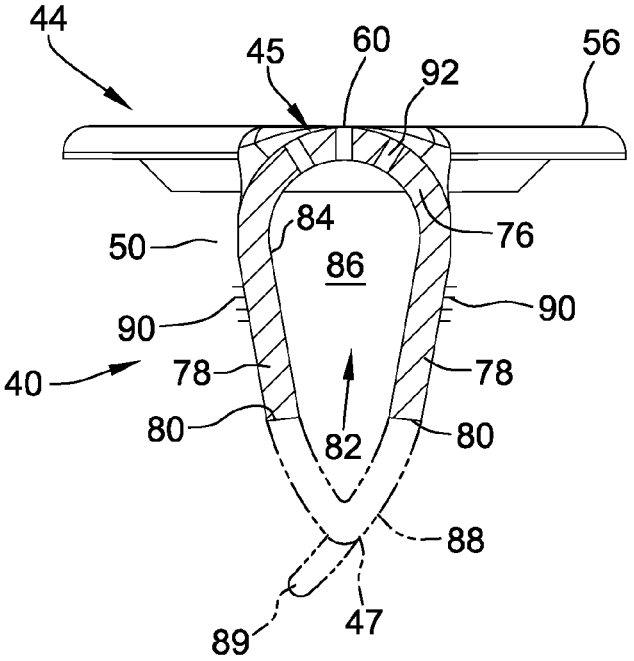
FIG. 6 is a cross-sectional view of the mounting arm shown in FIG. 4 taken along line 6-6.

FIG. 3 is a perspective view of an exemplary mounting arm 40 of the plurality of mounting arms for use with centrifugal blower 10 (shown in FIG. 1). FIG. 4 is a side view of mounting arm 40. FIG. 5 is a cross-sectional view of mounting arm 40 taken along line 5-5. FIG. 6 is a cross-sectional view of mounting arm 40 taken along line 6-6. In the exemplary embodiment, mounting arm 40 is contoured to reduce noise levels generated by blower 10 and to reduce airflow restrictions about inlet opening 36 (shown in FIG. 1). Each mounting arm 40 of the plurality of mounting arms 40 includes a first end 44, an opposing second end 46, and a body portion 48 extending therebetween. Body portion 48 includes a first body portion 50, including first end 44, a second body portion 52, including second end 46, and a junction 54 at the intersection of first body portion 50 and second body portion 52.

Furthermore, each mounting arm 40 includes a leading portion 45 and a trailing portion 47. As best shown in FIGS. 3 and 4, leading portion 45 and trailing portion 47 are oriented in a substantially constant direction. More specifically, leading and trailing portions 45 and 47 are oriented in substantially radial directions when mounted to blower 10 such that trailing portion 47 generally faces impeller 12 and leading portion 45 generally faces axis 14. Alternatively, mounting arm 40 may be twisted such that leading and trailing portions 45 and 47 are oriented in a substantially circumferential direction with respect to axis 14. More specifically, mounting arms 40 may be twisted to orient leading portion 45 in the predominate flow direction such that the airflow flows over mounting arms 40 from leading portion 45 to trailing portion 47. Accordingly, mounting arms 40 may be twisted to streamline the airflow and increase efficiency. Furthermore, twisting of mounting arms 40 may also begin to turn the airflow such that the airflow direction has an at least partially circumferential component before the airflow enters impeller 12.

In the exemplary embodiment, first end 44 includes a mounting bracket 56 formed integrally therewith that is coupled to housing 18 (shown in FIG. 1). Alternatively, mounting bracket 56 may be coupled to first end 44. Mounting bracket 56, as shown in FIG. 4, is substantially flat and is coupled to an outer surface 58 of sidewall 22. Mounting bracket 56 extends from an outer surface 60 of first body portion 50 and includes an opening 62 configured to receive a fastener (not shown) therethrough to couple mounting arm 40 to sidewall 22. At least one washer (not shown) may be positioned between mounting bracket 56 and mounting surface 58 and/or between mounting bracket 56 and the fastener to reduce transmission of vibrations between mounting arm 40 and sidewall 22.

First end 44 of mounting arm 40 also includes an end surface 64. In the exemplary embodiment, end surface 64, as shown in FIG. 4, includes an arcuate contour configured to correspond to an inlet surface 66 of inlet ring 42. In one embodiment, end surface 64 is spaced a distance from inlet surface 66 of inlet ring 42 such that a gap is defined therebetween. In another embodiment, end surface 64 is in contact with contour surface 66 such that no gap is defined therebetween. Alternatively, end surface 64 may be a flat surface that is perpendicular to sidewall 22 and does not include a curvature.

In the exemplary embodiment, second end 46 includes a mounting bracket 68 formed integrally therewith and configured to couple to motor 16 (shown in FIG. 1). Alternatively, mounting bracket 68 may be coupled to second end 46. Mounting bracket 68 includes opposing flanges 70 that extend from respective outer side surfaces 72 of second body portion 52. Each flange 70 includes an opening 74 configured to receive a fastener (not shown) therethrough to couple mounting arm 40 to motor 16. In the exemplary embodiment, flanges 70 are substantially flat such that mounting bracket 68 is configured to mount to a flat surface of motor 16. Alternatively, mounting bracket 68 may include an arcuate shape to enable mounting bracket 68 to couple to a cone (not shown) that is coupled to motor 16.

Referring now to FIGS. 5 and 6, in the exemplary embodiment, body portion 48 of mounting arm 40 includes cross-sectional profile that is a portion if an airfoil. In the exemplary embodiment, the aerodynamic profile is consistent throughout body portion 48 such that each of first body portion 50, second body portion 52, and juncture 54 include a substantially similar profile. Alternatively, the profile of mounting arm 40 may be relatively larger proximate ends 44 and 46 than at juncture 54 to account for higher stress levels where mounting arm 40 is coupled to housing 18 and motor 16. Generally, the cross-sectional profile of mounting arm 40 may vary between end 44 and 46. More specifically, the thickness and size of the cross-sectional profile may vary between ends 44 and 46 such that mounting arm 40 includes a first at least partial cross-sectional profile at a first point on arm 40 and a second at least partial cross-sectional profile at a second point along arm 40.

In the exemplary embodiment, the cross-sectional profile of mounting arm body portion 48 is substantially U-shaped. More specifically, the cross-sectional profile includes an arcuate portion 76 and two opposing legs 78 that extend from respective ends of arcuate portion 76 substantially toward impeller 12 (shown in FIG. 1). Legs 78 taper inward toward each other such that respective distal ends 80 of legs 78 define a gap 82 therebetween that is oriented towards impeller 12. In the exemplary embodiment, an inner surface 84 of mounting arm 40 defines a substantially hollow interior 86 accessed through gap 82.

In an alternative embodiment, shown by dashed lines in FIGS. 4 and 5, mounting arm 40 includes a full airfoil shaped cross-sectional profile wherein legs 78 form a V-shape portion 88 opposite arcuate portion 76. In such an embodiment, no gap is formed and inner surface 84 defines an enclosed hollow interior 86. In one embodiment, portion 88 is a separate component that is coupled to mounting arm 40 to create a full airfoil shape. Alternatively, portion 88 may be formed integrally with legs 78 and arcuate portion 76. In another embodiment, mounting arm 40 having the full airfoil profile is solid and does not include hollow interior 86. Furthermore, portion 88 may include a flap 89 extending from a vertex of portion 88 in a predetermined direction. In such an embodiment, flap 89 has a predetermined length and may be integrally formed with portion 88 or coupled thereto. Flap 89 is formed from a flexible material that enables flap 89 to move to guide the airflow in a predetermined direction.

In the exemplary embodiment, mounting arm 40 includes a boundary layer trip device 90 (shown in FIG. 6), such as, but not limited to, a textured surface, configured to create a turbulent boundary layer on mounting arm 40. More specifically, boundary layer trip device 90 is coupled to outer side surface 72 of legs 78. Alternatively, boundary layer trip device is formed in outer side surface 72 of legs 78. Boundary layer trip device 90 may be formed on any of first portion 50, second portion 52, and/or juncture 54 of body portion 48. In the exemplary embodiment, boundary layer trip device 90 is configured to disrupt the boundary layer over outer side surface 72 to create a transition from a laminar boundary layer upstream of boundary layer trip device 90 to a turbulent boundary layer downstream of boundary layer trip device 90.

Generally, boundary layer is defined between outer side surface 72 and a point above surface 72 where the air is undisturbed. As air flows within the boundary layer, the momentum of the boundary layer flow slows over the length of outer side surface 72. A separation point is defined along surface 72 where the boundary layer separates from surface 72 and forms a turbulent flow. Boundary layer separation causes adverse pressure gradients in the wake behind the separation point, which decrease the efficiency of blower 10. As such, it is advantageous for the boundary layer to remain attached to outer side surface 72 along as long of a length as possible, preferably until ends 80, such that there is no separation of the boundary layer from surface 72. Maintaining boundary layer attachment to a point as close as possible to ends 80 ensures that the airflow along outer side surface 72 is released into impeller 12 at an optimal angle, which improves impeller 10 efficiency and reduces noise levels.

In the exemplary embodiment, arcuate portion 76 of first body portion 50 includes at least one aperture 92 extending from outer surface 60 to interior 86. More specifically, apertures 92 are located at the stagnation point of first body portion 50 to enable axially-oriented air flowing through inlet opening 36 to pass through mounting arm 40. As such, the air flows through apertures 92 and into interior 86 such that the pressure within interior 86 is reduced.

Figure 7:
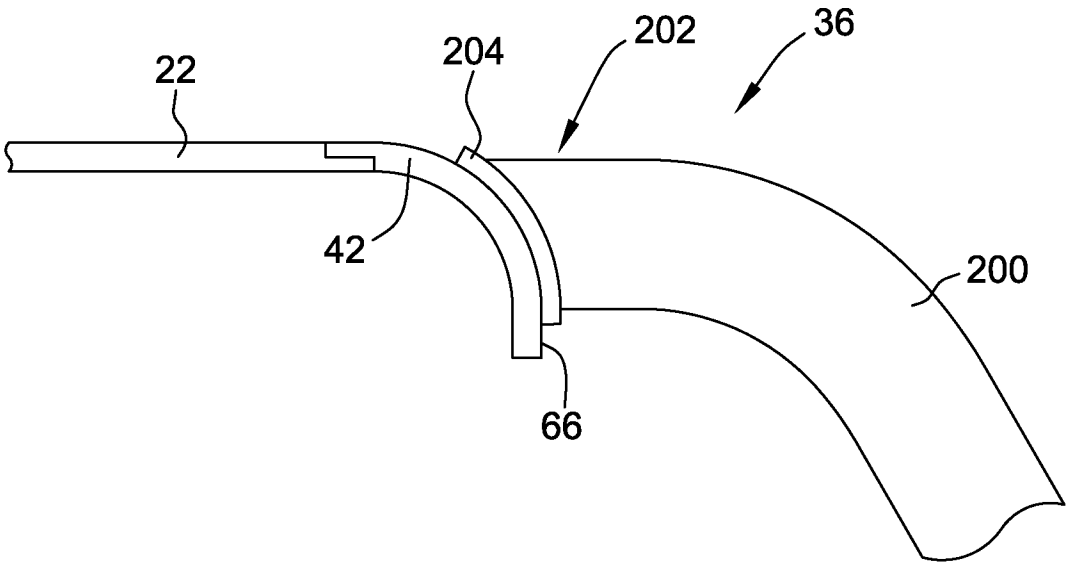
FIG. 7 is an alternative embodiment of a mounting arm for use with the centrifugal blower shown in FIG. 1.

FIG. 7 is an alternative embodiment of a mounting arm 200 for use with centrifugal blower 10 (shown in FIG. 1). Mounting arm 200 is substantially similar to mounting arm 40 except that mounting arm 200 includes a first end 202 that is coupled to inlet ring 42 instead of to sidewall 22. First end 202 includes a mounting bracket 204 that is curved in two directions. The first curvature corresponds to the circular shape of inlet opening 36, and the second curvature corresponds to the curvature of inlet surface 66 of inlet ring 42. Alternatively, first end 202 of mounting arm 200 may be integrally formed with inlet ring 42.

The apparatus, methods, and systems described herein provide a centrifugal blower having increased efficiency, reduced noise, and an improved airflow distribution at the blower inlet opening. More specifically, the mounting arms described herein include an aerodynamic profile that is more streamlined than known mounting arms to reduce an area upon which the airflow through the inlet opening impinges before entering the impeller blades, therefore increasing blower efficiency. The aerodynamic shape of the mounting arms align the airflow to allow entrance into the impeller blades in a single direction to further increase the efficiency of the blower. Furthermore, the aerodynamic mounting arms maintain cantilever stiffness of the mounting assembly such that vibration transmission to the housing is minimized. As such, the centrifugal blower described herein operates at a reduced noise level and higher efficiency because of the reduced vibrations and more streamlined airflow. The exemplary embodiments described herein provide apparatus, systems, and methods particularly well-suited for HVAC centrifugal blowers.

Exemplary embodiments of the centrifugal blower are described above in detail. The centrifugal blower and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A centrifugal blower assembly comprising:

a housing defining an interior space;

an impeller configured to channel an airflow within the interior space;

a motor coupled to said impeller and configured to rotate said impeller about an axis; and a plurality of mounting arms, wherein at least one mounting arm of the plurality of mounting arms includes a first end coupled to said housing and a second end coupled to said motor, said at least one mounting arm having a cross-sectional profile, wherein said cross-sectional profile comprises a portion of an airfoil shape, wherein said cross-sectional profile is taken from a radially inner surface of said at least one mounting arm to a radially outer surface of said at least one mounting arm, wherein the cross-sectional profile includes:

an arcuate portion;

a first leg extending from a first end of said arcuate portion; and a second leg extending from a second end of said arcuate portion, wherein said first leg and said second leg converge toward each other, and wherein one of said first leg or said second leg include a flap extending therefrom, said flap configured to guide the airflow in a predetermined direction.

2. The centrifugal blower assembly in accordance with claim 1, wherein said housing includes at least one sidewall and an inlet ring that define an inlet opening, said first end of said at least one mounting arm coupled to said at least one sidewall and spaced from said inlet ring.

3. The centrifugal blower assembly in accordance with claim 1, wherein said housing includes at least one sidewall and an inlet ring that define an inlet opening, said first end of said at least one mounting arm coupled to said inlet ring and spaced from said at least one sidewall.

4. The centrifugal blower assembly in accordance with claim 3, wherein said first end of said at least one mounting arm is integrally formed with said inlet ring.

5. The centrifugal blower assembly in accordance with claim 1, wherein said arcuate portion includes at least one aperture configured to enable a flow of air therethrough.

6. The centrifugal blower assembly in accordance with claim 1, wherein said at least one mounting arm of the plurality of mounting arms includes a boundary layer trip device configured to maintain attachment of a boundary layer with said mounting arm.

7. The centrifugal blower assembly in accordance with claim 1 further comprising a turning vane coupled to at least one of said plurality of mounting arms, said turning vane configured to distribute the airflow in a predetermined direction along said impeller.

8. The centrifugal blower assembly in accordance with claim 1, wherein said flap is flexible.

9. The centrifugal blower assembly in accordance with claim 1, wherein said first leg includes said flap such that said first leg includes a first length longer than a second length of said second leg.

* * * * *